US008720609B2

(12) United States Patent
Welch et al.

(10) Patent No.: US 8,720,609 B2
(45) Date of Patent: May 13, 2014

(54) DRILL BIT WITH CONTINUOUSLY SHARP EDGE CUTTING ELEMENTS

(75) Inventors: Robert M. Welch, The Woodlands, TX (US); Eric E. McClain, Spring, TX (US); L. Allen Sinor, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 174 days.

(21) Appl. No.: 12/250,443

(22) Filed: Oct. 13, 2008

(65) Prior Publication Data

US 2010/0089649 A1 Apr. 15, 2010

(51) Int. Cl.
*E21B 7/04* (2006.01)
*E21B 10/00* (2006.01)

(52) U.S. Cl.
USPC ..... 175/379; 175/431; 175/432; 175/434; 175/428

(58) Field of Classification Search
USPC ..... 175/379, 312, 431, 432, 12, 412
See application file for complete search history.

(56) References Cited

U.S. PATENT DOCUMENTS

| | | | | |
|---|---|---|---|---|
| 1,923,488 | A | 8/1933 | Howard et al. | |
| 3,140,748 | A | 7/1964 | Engle et al. | |
| 3,145,790 | A | 8/1964 | Bridwell et al. | |
| 4,397,361 | A | 8/1983 | Langford, Jr. | |
| 4,533,004 | A | 8/1985 | Ecer | |
| 4,719,979 | A | 1/1988 | Jones | |
| 4,813,500 | A | 3/1989 | Jones | |
| 4,913,247 | A | 4/1990 | Jones | |
| 5,025,873 | A * | 6/1991 | Cerkovnik | 175/431 |
| 5,103,922 | A * | 4/1992 | Jones | 175/429 |
| 5,115,873 | A | 5/1992 | Pastusek | |
| 5,147,001 | A | 9/1992 | Chow et al. | |
| 5,238,074 | A * | 8/1993 | Tibbitts et al. | 175/428 |
| 5,531,281 | A | 7/1996 | Murdock | |
| 5,551,522 | A | 9/1996 | Keith et al. | |
| 5,816,346 | A | 10/1998 | Beaton | |
| 5,957,227 | A | 9/1999 | Besson et al. | |
| 5,979,571 | A | 11/1999 | Scott et al. | |
| 5,992,549 | A | 11/1999 | Fuller | |
| 6,009,963 | A | 1/2000 | Chaves | |
| 6,068,072 | A | 5/2000 | Besson et al. | |
| 6,123,161 | A * | 9/2000 | Taylor | 175/397 |
| 6,234,261 | B1 | 5/2001 | Evans et al. | |
| 6,241,036 | B1 | 6/2001 | Lovato et al. | |
| 6,283,233 | B1 | 9/2001 | Lamine et al. | |
| 6,328,117 | B1 * | 12/2001 | Berzas et al. | 175/57 |

(Continued)

OTHER PUBLICATIONS

Sang Wook Kim, International Search Report for International Patent Application No. PCT/US2009/060413, Korean Intellectual Property Office, Republic of Korea, dated Mar. 24, 2010.

Sang Wook Kim, Written Opinion for International Patent Application No. PCT/US2009/060413, Korean Intellectual Property Office, Republic of Korea, dated Mar. 24, 2010.

Joung Hyun Ham, International Search Report for International Patent Application No. PCT/US2009/060408, Korean Intellectual Property Office, Republic of Korea, dated May 11, 2010.

(Continued)

*Primary Examiner* — James Sayre
(74) *Attorney, Agent, or Firm* — Sutton McAughan Deaver, PLLC

(57) ABSTRACT

A method of optimizing drill bit design and an optimized drill bit for drilling a well into an earth formation comprising a bit body; a number of blades spaced around the bit body, each blade having a curved outer edge and a forward face; a first row of cutter pockets recessed into the face along the outer edge of each blade; a second group of cutter pockets recessed into the face of each blade offset from the first row; and a plurality of cutting elements, each cutting element being brazed into a different one of the cutter pockets.

17 Claims, 9 Drawing Sheets

(56) References Cited

U.S. PATENT DOCUMENTS

| | | | | |
|---|---|---|---|---|
| 6,408,958 | B1 * | 6/2002 | Isbell et al. | 175/431 |
| 6,458,471 | B2 | 10/2002 | Lovato et al. | |
| 6,547,017 | B1 | 4/2003 | Vail, III | |
| 6,883,623 | B2 | 4/2005 | McCormick et al. | |
| 7,025,156 | B1 * | 4/2006 | Caraway | 175/426 |
| 7,048,081 | B2 | 5/2006 | Smith et al. | |
| 7,128,168 | B2 | 10/2006 | Youan | |
| 7,237,628 | B2 * | 7/2007 | Desai et al. | 175/406 |
| 7,278,499 | B2 | 10/2007 | Richert et al. | |
| 2002/0033282 | A1 | 3/2002 | Griffin et al. | |
| 2002/0069725 | A1 | 6/2002 | Watson et al. | |
| 2004/0238227 | A1 | 12/2004 | Smith et al. | |
| 2007/0240910 | A1 | 10/2007 | Kembaiyan et al. | |
| 2007/0261890 | A1 | 11/2007 | Cisneros | |

OTHER PUBLICATIONS

Se Gyoung Lee, International Search Report for International Patent Application No. PCT/US2009/060405, Korean Intellectual Property Office, Republic of Korea, dated Apr. 21, 2010.

Se Gyoung Lee, Written Opinion for International Patent Application No. PCT/US2009/060405, Korean Intellectual Property Office, Republic of Korea, dated Apr. 21, 2010.

J.H. Lee, International Search Report for International Patent Application No. PCT/US2009/060404, Korean Intellectual Property Office, dated May 27, 2010.

J.H. Lee, Written Opinion for International Patent Application No. PCT/US2009/060404, Korean Intellectual Property Office, dated May 27, 2010.

* cited by examiner

DRILL BIT WITH CONTINUOUSLY SHARP EDGE CUTTING ELEMENTS

CROSS REFERENCE TO RELATED APPLICATIONS

None.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to drill bits for drilling wells; and more specifically related to drill bits with super-abrasive cutting elements for drilling wells in earth formations.

2. Description of the Related Art

U.S. Pat. No. 1,923,488 discloses "a well drilling tool, such as a bit or the like, that embodies a simple, practical and improved cutting means whereby the tool is self-sharpening through use."

U.S. Pat. No. 3,140,748 discloses "an earth boring drill bit of the rigid bearingless type, known as a drag bit. Although the JQ emphasis in this application is on the use of such a bit in drilling through earth formations for oil, gas, and the like, it is to be understood that the invention is also useful in other earth boring applications, including mining and quarrying. Drilling bits that are characterized by long life under the above operating conditions, and that are also characterized by rapid penetration in a variety of formations from soft to hard, by low frequency of "pulls," by maintenance of substantially full hole gauge and by limitation of hole deviation within allowable limits, are very valuable to the petroleum industry. In addition, a satisfactory bit should be self-sharpening; and it should also have a certain geometry to penetrate rapidly through various formations. Where this geometry is initially present in the bit, it should be retained as the bit wears in use. In some cases, however, the desired bit geometry is created only as the bit wears in use and, once created, should be retained during further use. It is accordingly among the objects of this invention to provide a rotatable drag bit that will have the desirable characteristics mentioned above, including the capability of drilling in hard formations at a faster rate over longer periods of time than is obtainable with conventional bits, that will maintain a substantially full gauge hole in hard and abrasive rock formations, that will be self-sharpening, and that will have a wear pattern in use that will retain or create a desirable geometry for the bit."

U.S. Pat. No. 3,145,790 discloses "[a] milling tool (10) for processively cutting away a section of casing (14) installed within a well from the upper annular end (12) of the casing (14). The milling tool (10) includes a plurality of elongate blades (32) equally spaced from each other at intervals between one and three inches about the periphery of the cylindrical body (18) of the milling tool (10). The blades (32) are inclined with respect to the axis of rotation and hard carbide cutting discs (34) arranged in horizontal rows on the blades (32) form the inclined leading planar face of the blades (32), and the lowermost row of discs (34) forms a cutting edge with a negative rake engaging the upper end (12) of the casing (14) in a cutting operation."

U.S. Pat. No. 4,533,004 discloses "[a] self-sharpening rotary drag bit assembly comprises: (a) a carrier body adapted to be rotated about a first axis, and having a drilling end, (b) cutters carried by the body to be exposed for cutting at the drilling end of the body, the cutters having thereon layers of hard materials defining cutting edges to engage and cut the drilled formation as the body rotates, the cutters also including reinforcement material supporting said layers to resist deflection thereof under cutting loads, (c) said body and said reinforcement material being characterized as abradable by the formation as the bit drilling end rotates in engagement with the formation."

U.S. Pat. No. 4,719,979 discloses "[d]rag-type drilling bits are disclosed which have at least one blade and a plurality of fluid flow channels incorporated in the blade for conducting drilling fluid or drilling mud from the hollow interior of the bit to discharge or ejection ports located in the front cutting edge of the blade. Rods of diamonds or of like "hard" cutter insert materials are incorporated in the blade in such a configuration that as the blade wears away or erodes and small pieces of diamonds are lost during drilling, more diamonds are exposed to the formation for drilling. During erosion or wear of the blades, the fluid discharge ports continue to operate to eject drilling fluid adjacent to substantially each diamond rod, whereby the flushing away of cuttings and cooling of the diamonds is greatly improved. In some embodiments of the invention rods of alternating hard and soft materials are also disposed substantially parallel with the diamond or like "hard" cutter insert rods. When the soft material of the rods is exposed for drilling the formation, kerfs are formed which are thereafter "chipped away" by the subsequently exposed hard material of the rods."

U.S. Pat. No. 4,813,500 discloses "[a] fishtail type drag bit having abradable cutter blades attached to a body of the bit is disclosed. A multiplicity of axially aligned tubes are welded together to form a blade each blade being sustantially parallel with an axis of the bit body. Each tube of the blade contains an annulus of a diamond cutter material matrix. The center of the annulus forms a fluid conduit that communicates with a fluid plenum chamber formed by the body of the bit. The cutting edge of the diamond matrix therefore, is always immediately adjacent the fluid nozzle regardless of the degree of blade erosion during operation of the bit in a subterranean formation."

U.S. Pat. No. 4,913,247 discloses "drill bits [that] include a body member with cutter blades having a generally parabolic bottom profile. The cutter blades each include a diamond cutting face which increases in vertical height generally as a function of increased distance from the center line of the bit. The increased height allows the bits to provide a desired total diamond cutting volume at each radius of the bit, while allowing the diamond contact area to remain generally constant as the bit wears."

U.S. Pat. No. 5,025,873 discloses "a rotary drill bit including a cutting structure comprising an array of cutting elements oriented and arranged to facilitate concentration of the load on bit on groups of cutting elements until the elements become dulled or worn, at which point fresh cutting elements are exposed to engage the formation and tube the concentrated bit loading. Preferably, the cutting elements are configured and/or supported to break away from the cutting structure when worn to a certain extent, thereby facilitating exposure of fresh cutting elements to engage the formation."

U.S. Pat. No. 5,103,922 discloses "[a] fishtail type drag bit is disclosed consisting of multiple blades, each blade forming radially disposed grooves. Each groove contains equidistantly spaced diamond cutters along its length. The cutters are additionally oriented at a negative rake angle with respect to a borehole bottom. The vertical alignment of the diamond cutters paralleling an axis of the bit are staggered to destroy kerfs which remain in the formation from preceding eroded rows of diamond cutters as the bit works in the borehole."

U.S. Pat. No. 5,147,001 discloses "a cutting structure for earth boring drill bits and a bit including at least one such structure comprising a substantially planar array of cutting elements arranged in substantially contiguous mutual proximity, the array incorporating at least one discontinuity therein dividing it into a plurality of sub-arrays."

U.S. Pat. No. 5,238,074 discloses "[a] cutter for a rotating drag bit which has a cutting face formed from a plurality of polycrystalline diamond compact (PCD) elements. The elements can be of varying thickness and/or varying hardness to provide a cutting edge having a nonuniform wear pattern. Also provided is a cutter which includes two layers of PCD elements. The PCD elements can be of varying thickness and/or hardness to provide a cutter which presents a cutting edge having a wear ratio which varies with cutter wear. Also provided is an impact cutter having a cutting surface formed from one or more layers of PCD elements."

U.S. Pat. No. 5,551,522 discloses "A fixed cutter drill bit includes a cutting structure having radially-spaced sets of cutter elements. The cutter element sets preferably overlap in rotated profile and include at least one low profile cutter element and at least two high profile elements. The low profile element is mounted so as to have a relatively low exposure height. The high profile elements are mounted at exposure heights that are greater than the exposure height of the low profile element, and are radially spaced from the low profile element on the bit face. The high profile elements may be mounted at the same radial position but at differing exposure heights, or may be mounted at the same exposure heights but at different radial positions relative to the bit axis. Providing this arrangement of low and high profile cutter elements tends to increase the bit's ability to resist vibration and provides an aggressive cutting structure, even after significant wear has occurred."

U.S. Pat. No. 5,816,346 discloses "[a] rotary drill bit for drilling subsurface formations comprises a bit body having a shank for connection to a drill string, a plurality of primary blades and at least one secondary blade circumferentially spaced and extending outwardly away from a central axis of rotation of the bit, a plurality of cutters mounted along each blade, a majority of the cutters mounted on each of the primary blades having a greater exposure than a majority of the cutters on the secondary blade, and a sweep angle of the secondary blade is less than a sweep angle of the primary blades. The drill bit will exhibit a rate-of-penetration as a function of the size of the cutters on the primary blades, and exhibit a torque profile as a function of the size of the cutters on the at least one secondary blade."

U.S. Pat. No. 5,957,227 discloses "[a] drilling tool has several blades 16 each defining an outside wall 20 and two side walls 22, 24. The blades are separated by recesses 18, primary bits 28 are located along the outside wall of the blades, and secondary or backup bits 40 are attached behind the primary bits in relation to the direction of travel (f) of the tool. Each of the blades defines at least one divergent tunnel or channel 30 having small entry opening 32 located in the outside wall of the blade, behind the primary bits, and a larger exit opening 34 located on the rear side of the blade. The secondary bits are mounted at the rear edge of the entry opening, and the channel serves to discharge material excavated by them."

U.S. Pat. No. 5,979,571 discloses "[a] combination metal milling and earth drilling tool, for use in performing a single trip kickoff from a casing in a well bore. The combination milling and drilling tool has a first, relatively more durable cutting structure, such as tungsten carbide, and a second, relatively harder cutting structure, such as polycrystalline diamond. The more durable first cutting structure is better suited for milling metal casing, while the harder second cutting structure is better suited for drilling through a subterranean formation, especially a rock formation. The first cutting structure is positioned outwardly relative to the second cutting structure, so that the first cutting structure will mill through the metal casing while shielding the second cutting structure from contact with the casing. The first cutting structure can wear away while milling through the casing and upon initial contact with the rock formation, thereby exposing the second cutting structure to contact with the rock formation. The second cutting structure can then be used to drill through the rock formation."

U.S. Pat. No. 5,992,549 discloses "[a] cutting structure for a rotary drag-type drill bit includes a preform cutting element mounted on a carrier which, in use, is mounted on the drill bit and comprises a front facing table of superhard material bonded to a less hard substrate. A portion of the carrier on which the preform cutting element is mounted is shaped, adjacent the cutting element, for engagement by a chip of formation material being removed by the cutting element from the formation being drilled so as to tend to break the chip away from the surface of the formation. A portion of the carrier, or a portion of the bit body itself, may also be shaped, adjacent the cutting element, to direct to a location in front of the cutting element a flow of drilling fluid which impinges on said surface so as to assist in chip removal."

U.S. Pat. No. 6,283,233 discloses "[a] drill and/or core tool, in particular for oil drilling and/or coring, comprising a body (2) showing a substantially cylindrical peripheral surface (3) and a front (4), blades (5) which extend from the front (4) till over the peripheral surface (3) and which show each a leading edge (6), possibly PDC cutting elements (7) which are situated at least in a central area (15A) of the front (4) and the longitudinal axes of which are transverse to the rotation axis of the tool (1), and comprising moreover, on at least one blade (5), outside said central area (15A): PDC (7C) and/or secondary (10) cutting elements which show each a cutting edge (8), forming together the leading edge (6) of the blade (5), and the longitudinal axis of which is transverse to the rotation axis, and at least one associated cutting element (10A) which is situated behind at least one of the PDC (7C) or secondary (10) cutting elements, which shows a cross-section of the same shape, at least for its portion protruding from the blade (5), than that of the PDC (7C) or secondary (10) cutting element, and which is disposed on the same blade (5)."

U.S. Pat. No. 6,328,117 discloses "[a] chip breaker for use in a fixed-cutter, rotary-type drill bit used in drilling subterranean formations is disclosed. The chip breaker includes a knife-like protrusion positioned proximate a cutting element and adjacent or in a fluid course defined by the drill bit body. As formation chips, shavings, or cuttings are generated during drilling, the chips move over the protrusion and are split or scribed by the protrusion. Drilling fluid breaks the split or scribed chips away from the surface of the fluid course adjacent the cutting element and transports them through the junk slots. Additionally, chip splitters may be positioned on ramped surfaces that further lift the formation chips away from the surface of the fluid course."

U.S. Pat. No. 6,408,958 discloses "[a] cutting assembly comprised of first and second superabrasive cutting elements including at least one rotationally leading cutting element having a cutting face oriented generally in a direction of intended rotation of a bit on which the assembly is mounted to cut a subterranean formation with a cutting edge at an outer periphery of the cutting face, and a rotationally trailing cutting element oriented substantially transverse to the direction of intended bit rotation and including a relatively thick superabrasive table configured to cut the formation with a cutting edge located between a beveled surface at the side of the superabrasive table and an end face thereof. A rotationally trailing cutting element may be associated with and disposed at a location on the bit at least partially laterally intermediate locations of two rotationally leading cutting elements. Drill bits equipped with the cutting assembly are also disclosed."

U.S. Pat. No. 6,883,623 discloses "[a] rotary drill bit for drilling subterranean formations configured with at least one protective structure proximate to the rotationally leading and trailing edges of a gage trimmer, wherein the at least one protective structure is positioned at substantially the same exposure as its associated gage trimmer. Particularly, the apparatus of the present invention may provide protection for gage trimmers during drilling, tripping, and/or rotation within a casing; i.e., when changing a drilling fluid. Protective structures may be configured and located according to anticipated drilling conditions including helix angles. In addition, a protective structure may be proximate to more than one gage trimmer while having a substantially equal exposure to each associated gage trimmer. Methods of use and a method of rotary bit design are also disclosed."

U.S. Pat. No. 7,025,156 discloses "[a] rotary drill bit is used both for milling a casing window and drilling a lateral borehole into subterranean earthen materials, without the prior need of having separate drill bits for milling of the casing and for drilling of the borehole. The rotary drill bit is lowered into a casing set within a borehole; and the drill bit is rotated to engage an inner surface of the casing. A first set of cutting elements on the drill bit remove casing material to mill a casing window. The drill bit is then moved through the casing window so that a second set of cutting elements on the drill bit create a lateral wellbore in subterranean earthen material."

U.S. Pat. No. 7,048,081 discloses "[a] superabrasive cutting element for use with a drill bit for drilling subterranean formations and having a superabrasive table, or cutting face, in which a conglomerate of superabrasive particles is dispersed and bonded, or sintered, and in which at least one exposed cutting region of the superabrasive table develops a rough, asperital surface for improving the cutting efficiency of the drill bit, particularly in but not limited to relatively hard, relatively nonabrasive formations. The superabrasive table may include superabrasive particles of substantially differing size, or quality or a combination of differing size and quality. A rotary drill bit including cutting elements embodying the present invention is also disclosed."

U.S. Pat. No. 7,237,628 discloses "a drill bit with non-cutting erosion resistant inserts. In one illustrative embodiment, the apparatus comprises a matrix drill bit body comprising a plurality of blades, a plurality of cutting elements positioned on each of the blades, the cutting elements defining a plurality of web regions, and a plurality of spaced apart, non-cutting erosion resistant inserts positioned along a face of at least one of the blades, at least a portion of each of the non-cutting erosion resistant inserts being positioned in front of one of the web regions."

U.S. Pat. No. 7,278,499 discloses "[a] rotary drag bit including an inverted cone geometry proximate the longitudinal axis thereof is disclosed. The inverted cone region may include a central region, the central region including a plurality of cutting structures affixed thereto and arranged along at least one spiral path. The at least one spiral path may encircle its center of revolution at least once within the inverted cone region. A cone region displacement and a method for manufacturing a rotary drag bit therewith are disclosed. At least one groove may be formed within the cone region displacement along a respective at least one spiral path, the at least one spiral path encircling its center of revolution at least once. A plurality of cutting structures may be placed within the at least one groove and the cone region displacement may be placed within a mold for filling with an infiltratable powder and infiltrating with a hardenable infiltrant."

U.S. Patent Application No. 20070261890 discloses "[a] drill bit for drilling a borehole in earthen formations. In an embodiment, the bit comprises a bit body having a bit face comprising a cone region, a shoulder region, and a gage region. In addition, the bit comprises at least one primary blade disposed on the bit face, wherein the at least one primary blade extends into the cone region. Further, the bit comprises a plurality of primary cutter elements mounted on the at least one primary blade in the cone region. Still further, the bit comprises a plurality of backup cutter elements mounted on the at least one primary blade in the cone region, wherein the at least one primary blade has a cone backup cutter density and a shoulder backup cutter density, and wherein the cone backup cutter density of the at least one primary blade is greater than the shoulder backup cutter density of the at least one primary blade."

The inventions disclosed and taught herein are directed to an improved drill bit with continuously sharp cutting elements.

BRIEF SUMMARY OF THE INVENTION

The invention relates to a drill bit, such as for drilling a well into an earth formation, comprising a bit body, a plurality of blades spaced around the bit body, with each blade having a curved outer edge and a substantially flat forward face. A first row of cutter pockets are at least partially recessed into the face along the outer edge of each blade, forming a first curved cutting profile, and a second row of cutter pockets are at least partially recessed into the face of each blade offset from the first row, forming a second curved cutting profile. The second profile may be substantially identical to the first profile. In some embodiments, the second profile is offset vertically from the first profile. A plurality of cutting elements are preferably brazed into a different one of the cutter pockets. The pockets provide lateral support for the cutting elements. The cutting elements in the first row may be substantially identical to or different from the cutting elements in the second row. The cutting elements preferably extend from within the blade, through the face, and into a slot between the blades of the drill bit.

The drill bit may be used by rotating the drill bit and eroding or abrading the blades beyond cutting elements of a first row, thereby exposing cutting elements of a second row to the earth formation. Thus, at least initially, none of the cutting elements in the second row directly contact the formation until one or more cutting elements of the first row has eroded away from the blade. The bit body, blades, and pockets may be substantially simultaneously formed as a single unitary structure. Alternatively, the bit body, blades, and the first row of cutter pockets may be substantially simultaneously formed, with the second row of cutter pockets being formed in the blades thereafter. In some embodiments, the drill bit is assembled from individual components, such that the bit body and blades are formed separately. This allows the first and second rows of cutter pockets to be formed in each blade before the blade is welded or otherwise secured to the bit body.

The invention also relates to a method of optimizing drill bits, such as those for drilling a well into an earth formation. Optimization of a drill bit includes consideration of many factors, such as the size, shape, spacing, orientation, and number of blades; the size, shape, spacing, orientation, and number of cutters, or cutting elements; as well as the materials of the bit body, blades, cutting tables, and cutter substrates. All of these factors may be considered in light of the materials of the earth formation(s) for which the drill bit is designed.

DETAILED DESCRIPTION

Figure 1:
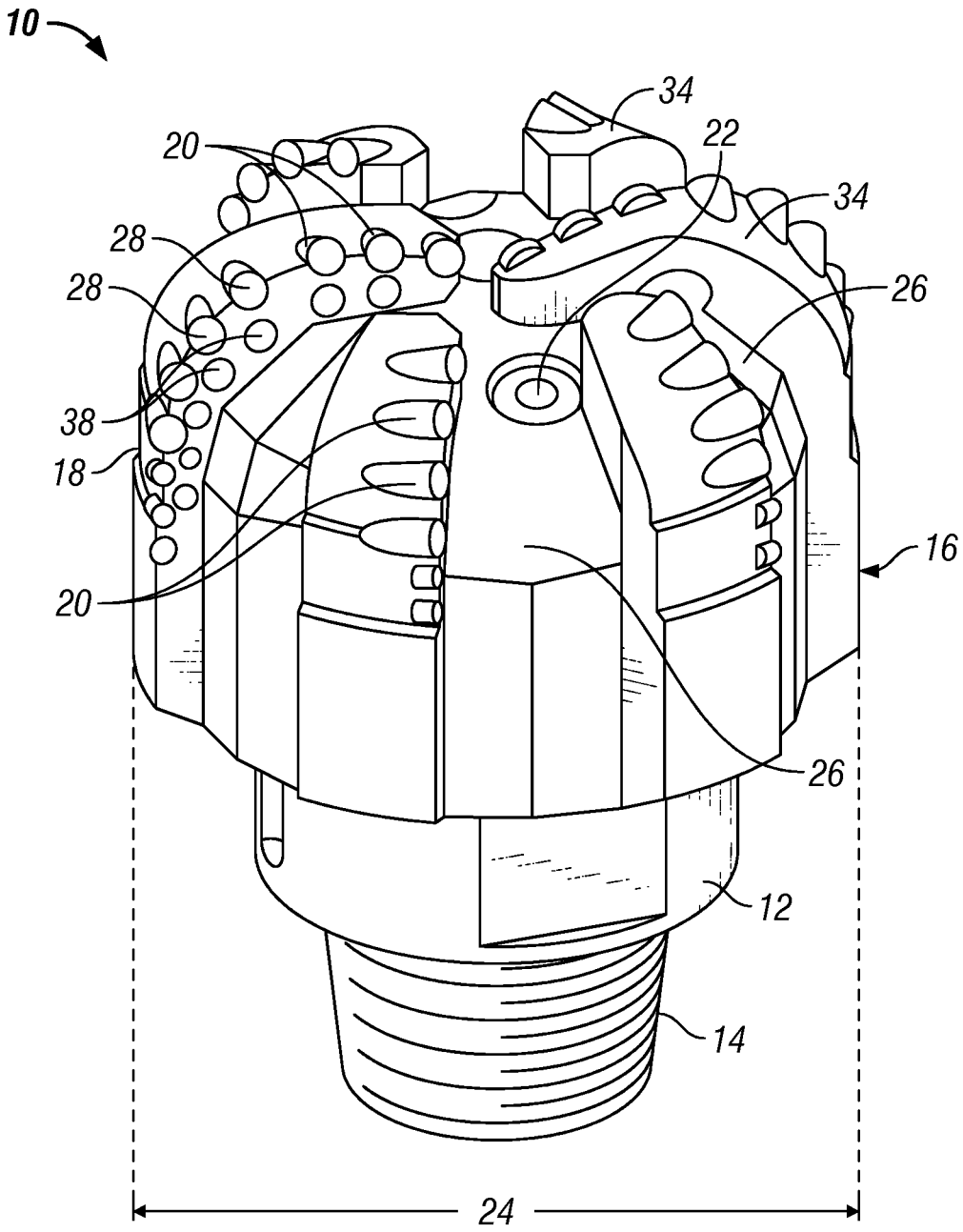
FIG. 1 illustrates a perspective view of an exemplary drill bit incorporating cutting elements and embodying certain aspects of the present inventions.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Particular embodiments of the invention may be described below with reference to block diagrams and/or operational illustrations of methods. In some alternate implementations, the functions/actions/structures noted in the figures may occur out of the order noted in the block diagrams and/or operational illustrations. For example, two operations shown as occurring in succession, in fact, may be executed substantially concurrently or the operations may be executed in the reverse order, depending upon the functionality/acts/structure involved.

Applicants have created a method for optimizing drill bit design and several embodiments of an optimized drill bit for drilling a well in an earth formation. In one embodiment, the optimized drill bit comprises a bit body; a plurality of blades spaced along the bit body, each blade having a curved outer edge and a forward face; a first row of cutter pockets recessed into the face along the outer edge of each blade; a second group of cutter pockets recessed into the face of each blade offset vertically from the first row; and a plurality of cutting elements, with each cutting element brazed or otherwise secured into a different one of the cutter pockets.

FIG. 1 is an illustration of a drill bit 10 that includes a bit body 12 having a conventional pin end 14 to provide a threaded connection to a conventional jointed tubular drill string rotationally and longitudinally driven by a drilling rig. Alternatively, the drill bit 10 may be connected in a manner known within the art to a bottomhole assembly which, in turn, is connected to a tubular drill string or to an essentially continuous coil of tubing. Such bottomhole assemblies may include a downhole motor to rotate the drill bit 10 in addition to, or in lieu of, being rotated by a rotary table or top drive located at the surface or on an offshore platform (not shown within the drawings). Furthermore, the conventional pin end 14 may optionally be replaced with various alternative connection structures known within the art. Thus, the drill bit 10 may readily be adapted to a wide variety of mechanisms and structures used for drilling subterranean formations.

The drill bit 10, and select components thereof, are preferably similar to those disclosed in U.S. Pat. No. 7,048,081, which is incorporated herein by specific reference. In any case, the drill bit 10 preferably includes a plurality of blades 16 each having a forward facing surface, or face 18. The drill bit 10 may have anywhere from two to sixteen blades 16. In a preferred embodiment, the drill bit 10 has three blades, which has been found to actually reduce wear, improve penetration, and increase cutter life. For example, according to one example, an eight bladed bit experienced 60% more wear that a three bladed bit, under identical circumstances. While in one preferred embodiment, the face 18 is substantially flat, it may be concave and/or convex.

The drill bit 10 also preferably includes a first, or primary, row of face cutters, or cutting elements, 20 secured directly to the blades 16. The drill bit 10 also preferably includes a plurality of nozzles 22 to distribute drilling fluid to cool and lubricate the drill bit 10 and remove cuttings. As customary in the art, gage 24 is the maximum diameter which the drill bit 10 is to have about its periphery. The gage 24 will thus determine the minimum diameter of the resulting bore hole that the drill bit 10 will produce when placed into service. The gage of a small drill bit may be as small as a few centimeters and the gage of an extremely large drill bit may approach a meter, or more. Between each blade 16, the drill bit 10 preferably has fluid slots, or passages, 26 into with the drilling fluid is fed by the nozzles 22.

Figure 2:
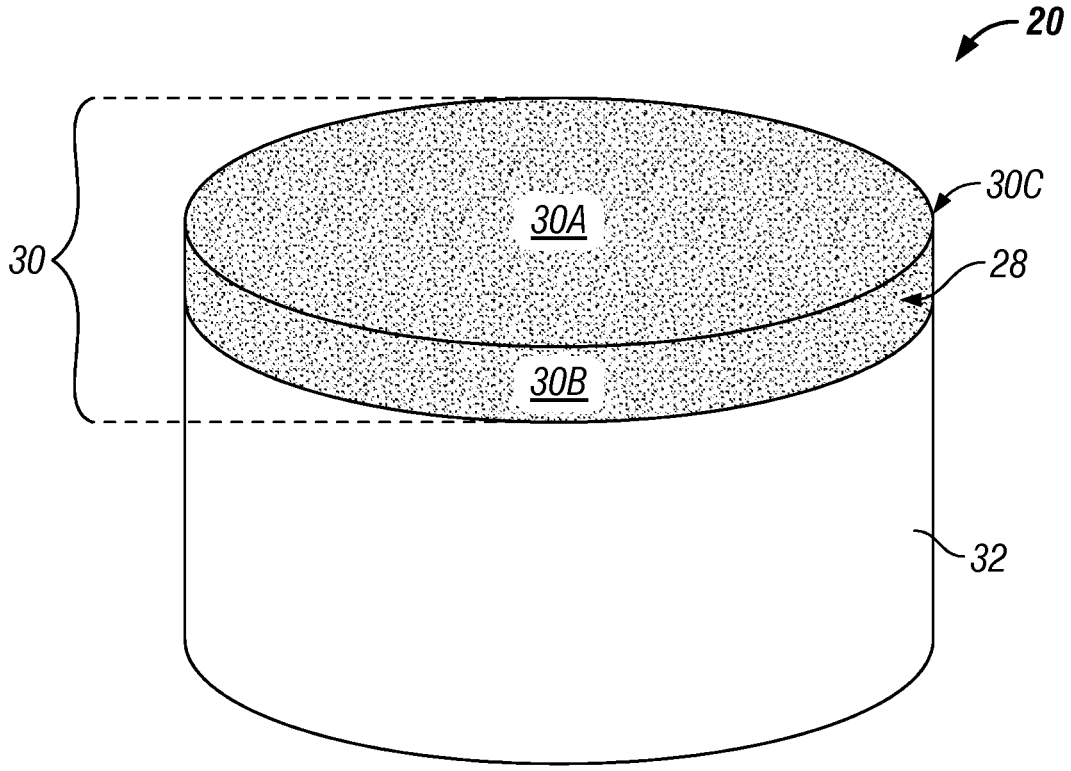
FIG. 2 is an enlarged perspective view of an exemplary cutting element embodying certain aspects of the present inventions.

An exemplary cutting element 20 of the present invention, as shown in FIG. 2, includes a super-abrasive cutting table 28 of circular, rectangular or other polygon, oval, truncated circular, triangular, or other suitable cross-section. The super-abrasive table 28, exhibiting a circular cross-section and an overall cylindrical configuration, or shape, is suitable for a wide variety of drill bits and drilling applications. The super-abrasive table 28 of the cutting element 20 is preferably formed with a conglomerated super-abrasive material, such as a polycrystalline diamond compact (PDC), with an exposed cutting face 30. The cutting face 30 will typically have a top 30A and a side 30B with the peripheral junction thereof serving as the cutting region of the cutting face 30 and more precisely a cutting edge 30C of the cutting face 30, which is usually the first portion of the cutting face 30 to contact and thus initially "cut" the formation as the drill bit 10 retaining the cutting element 20 progressively drills a bore hole. The cutting edge 30C may be a relatively sharp approximately ninety-degree edge, or may be beveled or rounded. The super-abrasive table 28 will also typically have a primary underside, or attachment, interface joined during the sintering of the diamond, or super-abrasive, layer forming the super-abrasive table 28 to a supporting substrate 32 typically formed of a hard and relatively tough material such as a cemented tungsten carbide or other carbide. The substrate 32 may be preformed in a desired shape such that a volume of particulate diamond material may be formed into a polycrystalline cutting, or super-abrasive, table 28 thereon and simultaneously strongly bonded to the substrate 32 during high pressure high temperature (HPHT) sintering techniques practiced within the art. Alternatively, the substrate 32 may be formed of steel, or other strong material with an abrasion resistance less than that of tungsten carbide and/or the earth formation being drilled. In still other embodiments, the substrate 32 may comprise a relatively thin tungsten carbide layer backed by a steel body.

In any case, the substrate 32 may be cylindrical, conical, tapered, and/or rectangular in over-all shape, as well as, circular, rectangular or other polygon, oval, truncated circular, and/or triangular, in cross-section. A unitary cutting element 20 will thus be provided that may then be secured to the drill bit 10 by brazing or other techniques known within the art, such as gluing, press fitting, and/or using a stud mounting technique.

In accordance with the present invention, the super-abrasive table 28 preferably comprises a heterogeneous conglomerate type of PDC layer or diamond matrix in which at least two different nominal sizes and wear characteristics of super-abrasive particles, such as diamonds of differing grains, or sizes, are included to ultimately develop a rough, or rough cut, cutting face 30, particularly with respect to the cutting face side 30B and most particularly with respect to the cutting edge 30C. In one embodiment, larger diamonds may range upwards of approximately 600 μm, with a preferred range of approximately 100 μm to approximately 600 μm, and smaller diamonds, or super-abrasive particles, may preferably range from about 15 μm to about 100 μm. In another embodiment, larger diamonds may range upwards of approximately 500 μm, with a preferred range of approximately 100 μm to approximately 250 μm, and smaller diamonds, or super-abrasive particles, may preferably range from about 15 μm to about 40 μm.

The specific grit size of larger diamonds, the specific grit size of smaller diamonds, the thickness of the cutting face 30 of the super-abrasive table 28, the amount and type of sintering agent, as well as the respective large and small diamond volume fractions, may be adjusted to optimize the cutter 20 for cutting particular formations exhibiting particular hardness and particular abrasiveness characteristics. The relative, desirable particle size relationship of larger diamonds and smaller diamonds may be characterized as a tradeoff between strength and cutter aggressiveness. On the one hand, the desirability of the super-abrasive table 28 holding on to the larger particles during drilling would dictate a relatively smaller difference in average particle size between the smaller and larger diamonds. On the other hand, the desirability of providing a rough cutting surface would dictate a relatively larger difference in average particle size between the smaller and larger diamonds. Furthermore, the immediately preceding factors may be adjusted to optimize the cutter 20 for the average rotational speed at which the cutting element 20 will engage the formation as well as for the magnitude of normal force and torque to which each cutter 20 will be subjected while in service as a result of the rotational speeds and the amount of weight, or longitudinal force, likely to be placed on the drill bit 10 during drilling.

While PDC cutters, such as those discussed above, are used in a preferred embodiment, other cutters may be used alternatively and/or additionally. For example, cutters made of thermally stable polycrystalline (TSP) diamond, in triangular, pin, and/or circular configuration, cubic boron nitride (CBN), and/or other superabrasive materials may be used. In some embodiments, even simple carbide cutters may be used.

Figure 3:
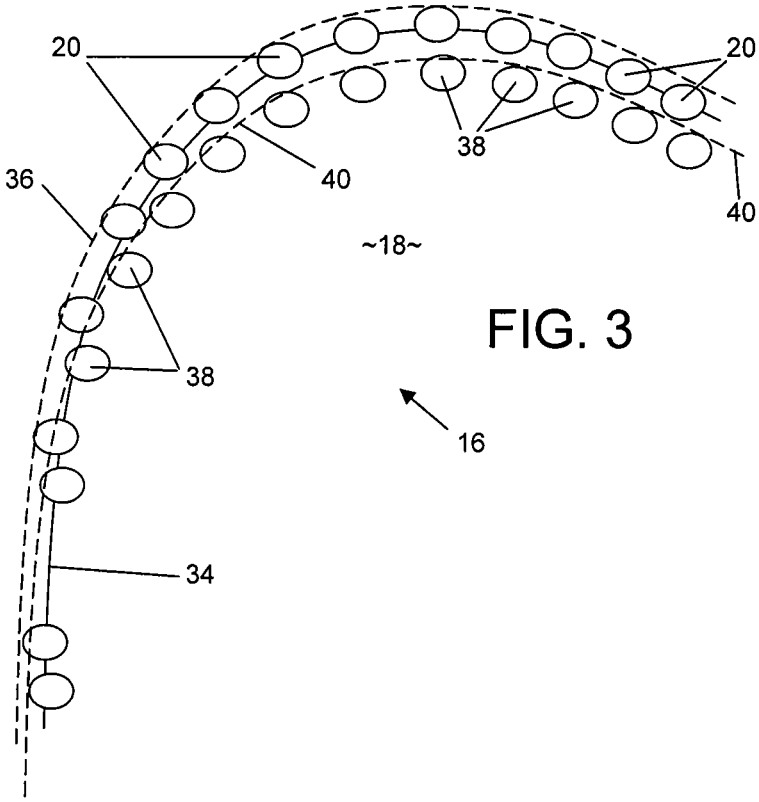
FIG. 3 is a partial elevation view of a blade of a drill bit according to certain aspects of the present inventions.

Referring also to FIG. 3, the first, or primary, row of face cutters 20 are preferably spaced along a curved outer edge 34 of the face 18 of each blade 16, forming a first, or primary, curved cutting profile 36. The first row of face cutting elements 20 are preferably recessed into both the outer edge 34 and the face 18 at an angle that provides a negative back rake to the cutting face 30. In the preferred embodiment, each blade 16 further includes a second, or secondary, row of face cutting elements 38. The secondary row of face cutting elements 38 preferably forms a second, or secondary, curved cutting profile 40. The second profile 40 is preferably offset from the first profile 36, but may otherwise be identical to the first profile 36. In a preferred embodiment, the second profile 40 is offset substantially vertically from the first profile 36. When the drill bit 10 is in use, as will be discussed in more detail below, the second profile 40 is preferably offset upwardly from the first profile 36. Because the second profile 40 may be offset substantially vertically from the first profile 36, the gage 24 may remain substantially the same after transitioning to the second row of face cutters 38, as will be discussed in more detail below.

Figure 4:
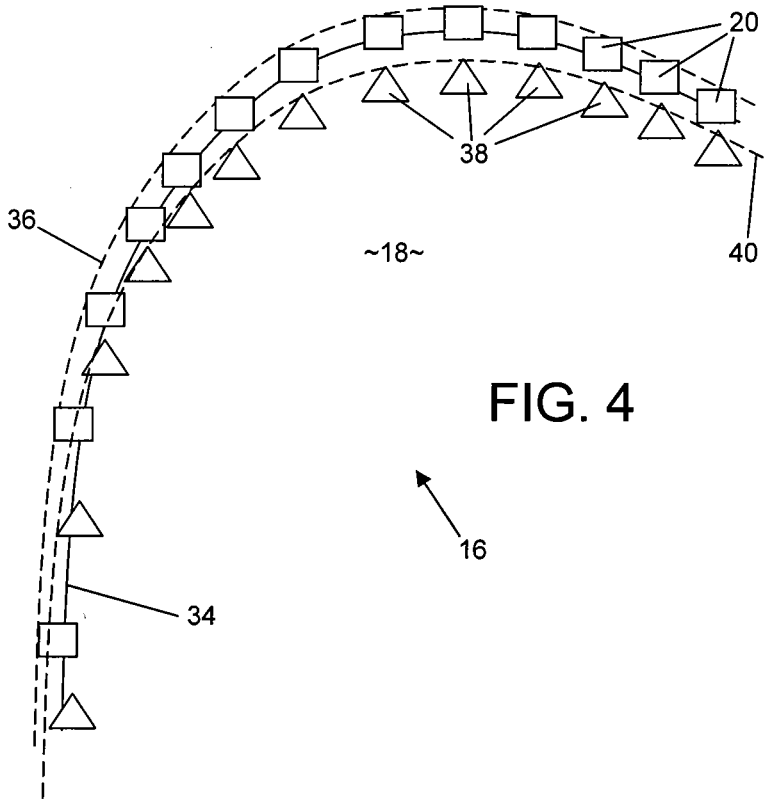
FIG. 4 is another partial elevation view of a blade of a drill bit according to certain aspects of the present inventions.

Referring also to FIG. 4, the first row of face cutters 20 may be of a different size, shape, configuration, and/or composition when compared to the second row of face cutters 38. For example, as shown, the first row of cutting elements 20 may be substantially square in cross-section, while the second row of cutting elements 38 are substantially triangular in cross-section. However, any of the above discussed configurations of the individual face cutters 20,38 may be embodied in the first and/or second rows.

Figure 5:
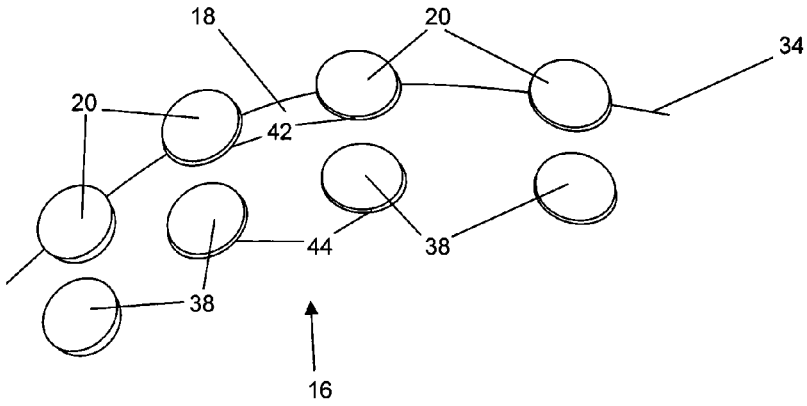
FIG. 5 is a close-up partial elevation view of a blade of a drill bit according to certain aspects of the present inventions.
Figure 6:
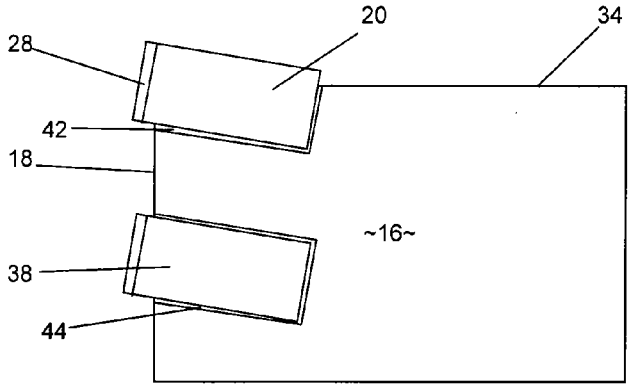
FIG. 6 is a partial sectional view of a blade of a drill bit according to certain aspects of the present inventions.

Referring also to FIG. 5 and FIG. 6, each cutter 20 of the first row is preferably disposed at least partially within an individual cutter pocket 42. Likewise, each cutter 38 of the second row is preferably disposed at least partially within an individual cutter pocket 44. Therefore, the cutter pockets 42,44 are also arranged in first and second rows that follow the first and second curved cutting profiles 36,40. As shown, the first row of pockets 42 are at least partially recessed into the face 18 of the blades 16, along the outer edge 34. The first row of pockets 42, therefore, preferably leave a portion of the first row of face cutters 20 exposed to the formation being drilled. At least initially, the second row of pockets 44 are recessed into the face 18 of the blades 16 offset from the first row of pockets 42, according to the cutting profiles 36,40. Therefore, the second row of face cutters 38 may not initially contact the formation directly. Each pocket 42,44 preferably holds one of the face cutters 20,38, thereby providing lateral support to each cutter 20,38. Each of the face cutters 20,38, preferably extends from within its pocket 42,44 through the face 18 of the blade 16 and into the slot 26 in front of the blade 16.

As the drill bit 10 is used, the first row of cutting elements 20 is worn and eventually erodes away. The blades 16 are normally protected from contact with the formation being drilled by the first row of face cutters 20. When one or more of the cutters from the first row of face cutters 20 wear, or erode away, the blades 16 themselves are forced into contact with the formation causing relatively rapid wear or erosion, or abrasion, of the blades 16 with little if any cutting of the formation. This relatively rapid wear of the blade 16 eventually exposes, to the formation, one or more cutters from the second row of face cutting elements 38. The second row of face cutting elements 38 then begin cutting through the formation. Therefore, the drill bit 10 can remain in service long after any one or more of the first row of face cutters 20 has completely worn away, thereby reducing downtime and expense associated with bit changes.

It can be seen that the present invention provides more than a single row of face cutters 20,38. These first, or primary, and second, or secondary, face cutters 20,38 are not to be confused with backup cutters commonly placed on the outer edge of the blades 16 behind the first row of cutters 20. Rather, the secondary face cutters 38 are placed on the face 18 of the blades 16, offset from the primary face cutters 20. In one preferred embodiment, the offset is preferably vertical, such that the secondary face cutters 38 are higher on the face 18 of the blades 16, with respect to the primary face cutters 20, when the drill bit 10 is in use.

The blades 16 are typically made from steel or a metal binder matrix, such as a matrix of carbide powder impregnated with an alloy binder during a casting process. For example, the drill bit 10 may be constructed as a matrix style drill bit using an infiltration casting process whereby a copper alloy binder is heated past its melting temperature and allowed to flow, under the influence of gravity, into a matrix of carbide powder packed into, and shaped by, a graphite mold. The mold is preferably a graphite negative of the shape of the drill bit 10. The mold preferably contains the shapes of the blades 16 and slots 26 of the drill bit 10, creating a form for the matrix. Other features may be made from clay and/or sand and attached to the mold.

A mold assembly may also include one or more displacement elements. For example, the mold assembly may include a plurality of nozzle displacements to accommodate the eventual installation of the nozzles 22. The displacements may be made of glued sand, a clay material, and/or graphite. For example, they may consist of a graphite outer layer filled with sand.

The mold assembly may also include a plurality of cutter pocket displacements. The cutter pocket displacements are small graphite pieces that retain the physical positions of cutter pockets in the matrix and resulting bit. Once the bit has been successfully molded, the cutter pockets 42,44 formed by the displacements may be further machined to provide locations into which the face cutters 20,38 are brazed or otherwise secured. In this manner, both the first and second rows of cutter pockets 42,44 may be formed simultaneously with the bit body 12, the blades 16, and the slots 26 as a single unitary structure. Alternatively, both the first and second rows of cutter pockets 42,44 may be machined into the blades 16, after the bulk of the drill bit 10 has been formed. In still another embodiment, the first row of cutter pockets 42 may be formed simultaneously with the bit body 12, the blades 16, and the slots 26, in the manner described above, with the second row of cutter pockets 44 being formed in the blades 16 thereafter.

Of course, other methods of constructing the drill bit 10 may be used. For example, the bit body 12 and the blades 16 may be constructed separately, using modular components and/or construction techniques. More specifically, the bit body 12 and the blades 16 may be constructed of steel and welded together after milling or machining the first and second rows of cutter pockets 42,44. This construction may make it easier to obtain desired cutter orientation, such as back rake and/or side rake, especially with higher blade counts. Alternatively, the drill bit 10 may be constructed using hybrid techniques, such as layered or multistage molding techniques.

According to certain aspects of the present invention, rather than constructing the drill bit 10 from the strongest, most durable and abrasion resistant materials available, it may beneficial to make portions of the drill bit 10 sacrificial. For example, with drilling rig day rates often significantly exceeding the cost of drill bits, designing a drill bit that minimizes the cost of drilling operations is paramount. Historically, drill bits have been designed to be as durable and wear resistant as possible. Unfortunately, due to the extreme environment in which they are expected to perform, all known drill bits experience wear. More specifically, as the cutting elements 20 wear, wear flat areas develop on the bit body 12, blades 16, and the cutters 20 themselves. These wear flat areas abrade against the earth formation, such as rock, and cause unproductive heat, drag, as well as other harmful byproducts of the drilling operation. The heat and drag further degrade the drill bit 10 and increases the wear flat problem, requiring more and more energy as well as decreasing rate of penetration. More specifically, increased wear flat area increases the specific energy, or the energy required to remove a unit volume of rock. At some point, the wear flat area becomes so great that the specific energy required is too great, drilling efficiency is therefore lost, and the drill bit 10 must be replaced.

In some cases, rather than just wearing, one or more of the cutting elements 20 may fail catastrophically. When this happens, the earth formation essentially grinds against that portion of the bit body 12, that was previously protected by the failed cutting element(s). This drastically increases the wear flat area, increasing the required specific energy, and may quickly lead to a ring-out, where the fluid, or junk, slots 26 get cut-off, dramatically increasing the mud system pressures.

In any case, once the drill bit 10 fails and/or drilling efficiency is lost, the drill bit 10 must be replaced. Replacing drill bits is a time-consuming, and therefore costly, proposition. As such, the present invention is more broadly directed to a method of optimizing the design and performance of drill bits, as well as the optimized drill bits themselves. The drill bit 10 of the present invention is designed to continue efficient drilling operations through failure of one or more cutting elements 20,38.

Figure 7:
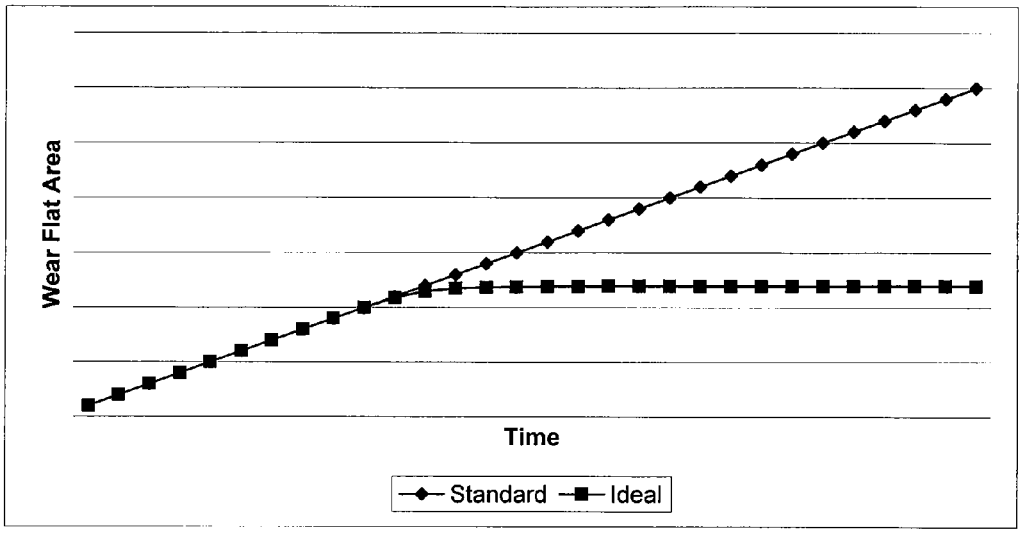
FIG. 7 is a graph showing wear flat areas of standard and optimized drill bits.

Referring also to FIG. 7, as a standard drill bit is used, over time, that drill bit's wear flat area continually increases as rate of penetration decreases and specific energy increases until drilling efficiency is lost and the drill bit must be replaced. The method of the present invention seeks to optimize drill bit design, such as by optimizing cutter placement and spacing, in order to manage or minimize the wear flat area and the required specific energy, and therefore maximize drilling efficiency. Thus, ideally, the wear flat area of the optimized drill bit 10 of the present invention would not continue to increase beyond a maximum designed total wear flat area. Rather, a drill bit according to the present invention could continue to be useful, albeit in a somewhat inefficient state, by management of the wear flat area.

Figure 8:
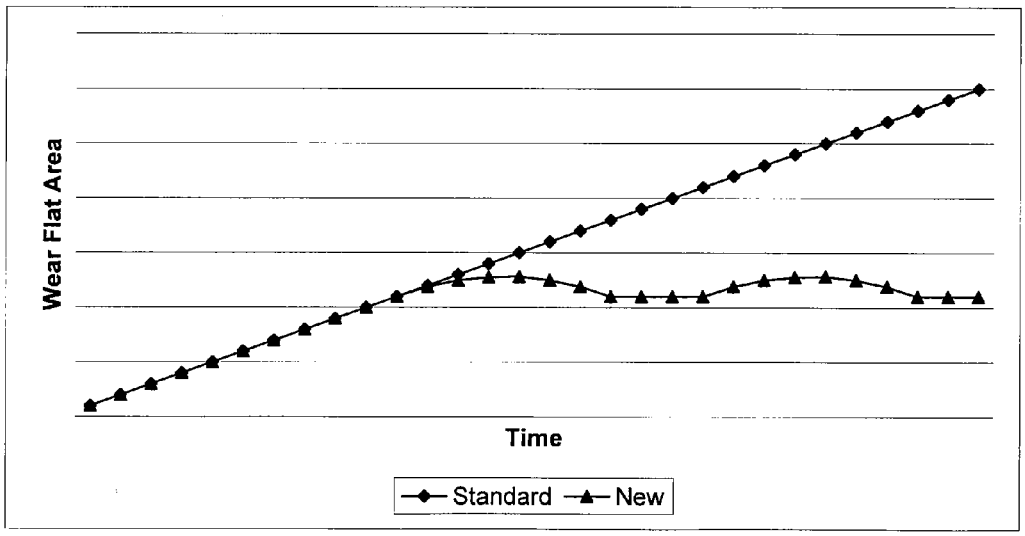
FIG. 8 is a graph showing wear flat areas of standard and a preferred embodiment of an optimized drill bit according to certain aspects of the present inventions.

Referring also to FIG. 8, in one embodiment, the wear flat area of the drill bit 10 of the present invention increases until the maximum designed total wear flat area is approached. The drill bit 10 maintains the wear flat area at or below the maximum designed total wear flat area until one or more of the primary face cutters 20 begins to fail. At that point, the wear flat area increases, possibly slightly above the maximum designed total wear flat area, until one or more of the secondary face cutters 38 is exposed and begins cutting the formation, decreasing the wear flat area well below the maximum designed total wear flat area. In this manner, the optimized drill bit 10 of the present invention can continue to drill, albeit in a somewhat inefficient state, thereby minimizing drilling rig down-time and the required specific energy while maintaining an acceptable rate of penetration and maximizing overall drilling efficiency through one or more cutter failures.

Figure 9:
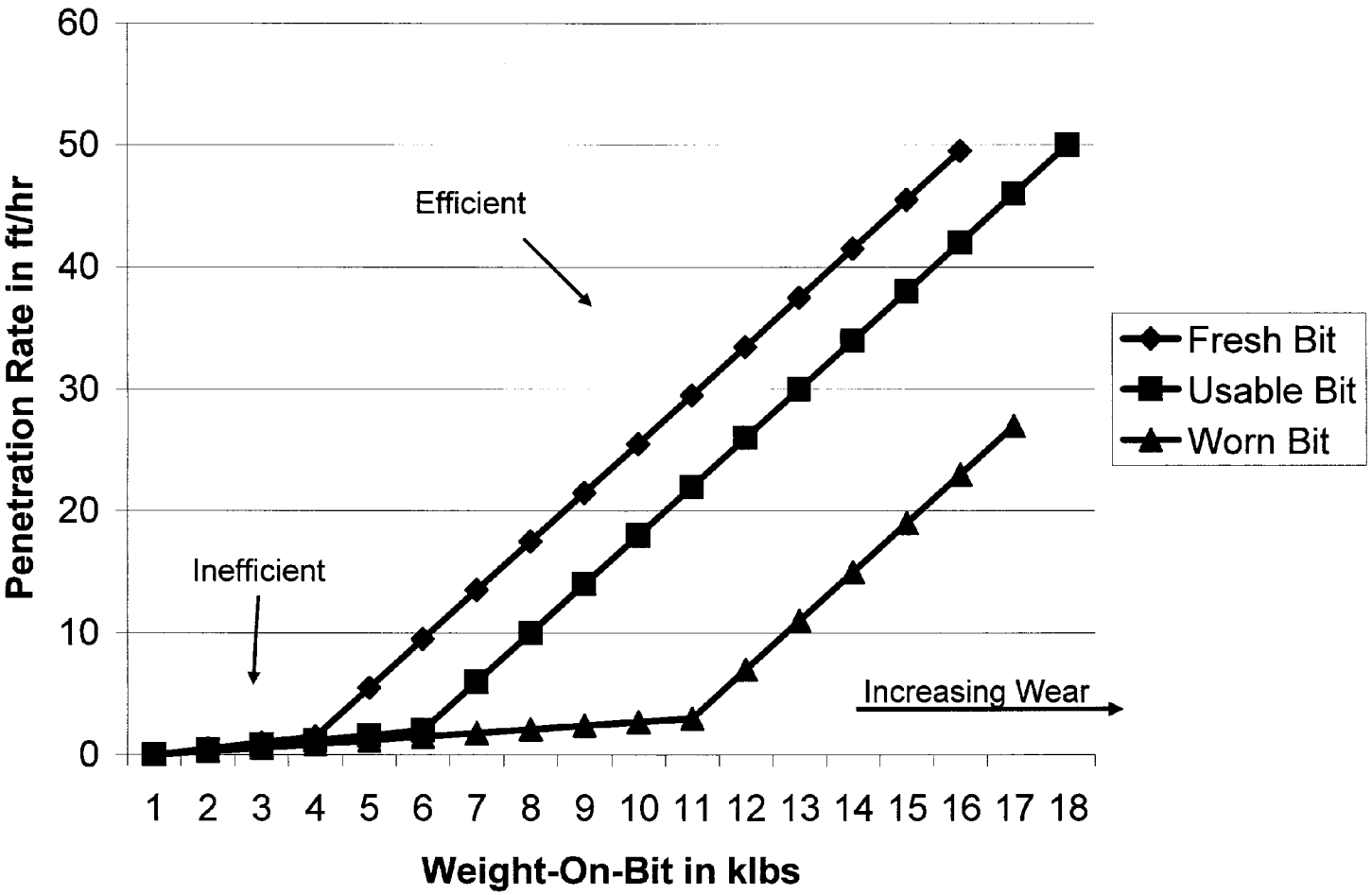
FIG. 9 is a graph showing a relationship between wear and performance for drill bits.

Referring the FIG. 9, this can be explained in terms of weight on bit versus rate of penetration and specific energy. The diamond accented plot on the left, of FIG. 9, shows the efficiency of a fresh, or new, bit. The triangle accented plot on the right, of FIG. 9, shows the efficiency of a worn, or unusable, bit. As can be seen, the bits exhibit relative inefficiency until some weight on bit is achieved, at which point they begin to provide much greater rates of penetration. It can also be seen that it takes much more weight on bit before the worn bit begins to exhibit any significant rate of penetration. It should be understood that the greater the weight on bit, the greater the specific energy required to drill.

Therefore, the drill bit 10 of the present invention preferably stays between the performance of the diamond accented plot on the left, of FIG. 9, of the new bit and the triangle accented plot on the right, of FIG. 9, of the worn bit. The drill bit 10 of the present invention preferably stays closer to performance of the new bit, but may oscillate about the square accented plot in the middle, of FIG. 9, for a usable bit.

Therefore, in some embodiments, the blades 16 and/or other portions of the bit body 12 are preferably made of a material with less abrasion resistance than that of the cutting table 28, substrate 32, and/or the earth formation into which the drill bit 10 is drilling. One or more of the face cutters 20,38 may be designed to fail dramatically or catastrophically, once failure begins, rather than continue to contribute to the wear flat area. These two design optimizations contribute to drilling efficiency by leading to more rapid engagement of the secondary face cutters 38.

Upon reading this disclosure, it can be appreciated that the design of a drill bit includes consideration of many factors, such as the size, shape, spacing, orientation, and number of blades; the size, shape, spacing, orientation, and number of cutters, or cutting elements; as well as the materials of the bit body, blades, cutting tables, and substrates. All of these factors may be considered in light of the materials of the earth formation(s) for which the drill bit is designed and/or matched.

It can be seen that, in order to rapidly expose the secondary face cutters 38, the bit body 12 is preferably made of a material with an abrasion resistance less than the abrasiveness of the earth formation. Clearly, the cutting tables 28 must be made from a material with an abrasion resistance greater than the abrasiveness of the earth formation, in order to cut therethrough. Because the substrate 32 is intended to provide support to the cutting table 28, rather than significantly contribute to the rate of penetration, the substrate 32 may be made of a material with an abrasion resistance less than the abrasiveness of the earth formation. As discussed above, because the bit body 12 is intended to provide support to the cutting elements 20,38, rather than contribute to the rate of penetration, the bit body 12 and/or blades 16 may be made of a strong material with an abrasion resistance less than the abrasiveness of the earth formation.

The above differences in abrasiveness can be accomplished in terms of independently specified material properties. For example, the optimized drill bit 10 according to the present invention may be designed such that the cutting table 28 is made of a cutting material with a minimum abrasion resistance, significantly higher than the abrasiveness of the earth formation. The optimized drill bit 10 according to the present invention may be designed such that the substrate material is made of a substrate material with a minimum and/or maximum abrasion resistance, which is preferably lower than the abrasiveness of the earth formation. Finally, optimized drill bit 10 according to the present invention may be designed such that the blade 16 is made of a blade or bit body material with a minimum and/or maximum abrasion resistance, which is preferably significantly lower than the abrasiveness of the earth formation.

Alternatively, the above differences in abrasiveness can be accomplished in terms of specified ratios. For example, an optimized drill bit 10 according to the present invention may be designed to maintain a minimum ratio of abrasion resistance between: the cutting table 28 and the blade 16; the cutting table 28 and the substrate 32; and/or the substrate 32 and the blade 16. In any case, as discussed above, the abrasiveness of the earth formation is preferably such that at least the blade material erodes rather quickly when and where it comes into frictional contact with the earth formation. Additionally, as discussed above, the abrasiveness of the earth formation may be such that the substrate material erodes rather quickly when and where it comes into frictional contact with the earth formation. Therefore, a minimum abrasion ratio may also be specified between: the earth formation and the blade material; the earth formation and the substrate material; and/or the earth formation and the cutting material.

In any case, it can be appreciated that a pre-designed and pre-manufactured drill bit may be selected based on the earth formation predicted and/or encountered. Alternatively, a drill bit may be specifically designed for the earth formation predicted and/or encountered.

Figure 10:
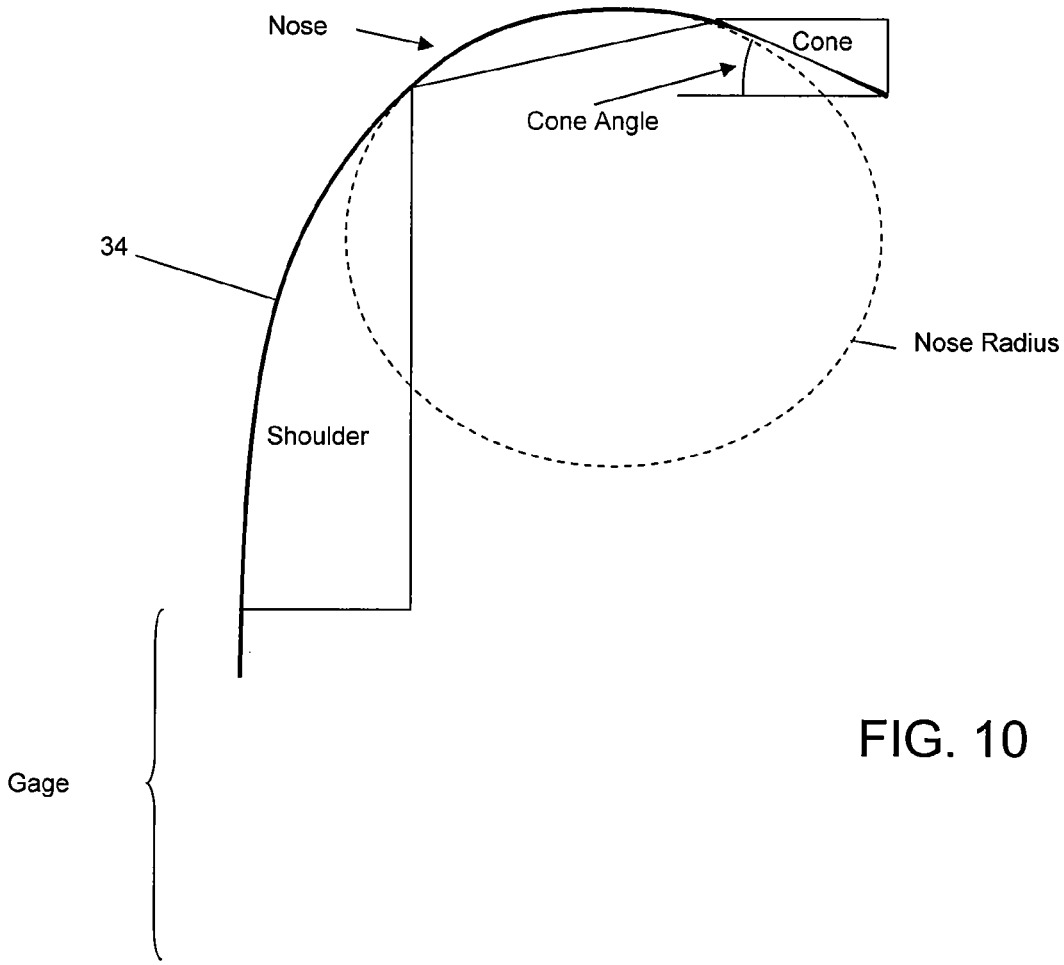
FIG. 10 is another partial elevation view of a blade of a drill bit according to certain aspects of the present inventions.

It has been discovered that the blades 16 rarely wear evenly. Therefore, it may be desirable to optimize the design of the blades 16 and the distribution and/or spacing of cutting material along the blades 16, to increase drill bit useful life and minimize the required specific energy while maintaining an acceptable rate of penetration and drilling efficiency. The blades 16 of modern drill bits often have three or more sections that serve related and overlapping functions. Specifically, referring also to FIG. 10, each blade 16 preferably has a cone section, nose section, a shoulder section, and a gage section.

The cone section of each blade is preferably a substantially linear section extending from near a center-line of the drill bit 10 outward. Because the cone section is nearest the center-line of the drill bit 10, the cone section does not experience as much, or as fast, movement relative to the earth formation. Therefore, it has been discovered that the cone section experiences less wear than the other sections. Thus, the cone section can maintain effective and efficient rate of penetration with less cutting material. This can be accomplished in a number of ways. For example, the cone section may have fewer face cutters 20,38, smaller face cutters 20,38, more spacing between face cutters 20,38, and/or may not even require secondary face cutters 38 at all. The cone angle for a PDC bit is typically 15-25°, although, in some embodiments, the cone section is essentially flat, with a substantially 0° cone angle.

The nose represents the lowest point on a drill bit. Therefore, the nose cutter is typically the leading most cutter. The nose section is roughly defined by a nose radius. A larger nose radius provides more area to place face cutters in the nose section. The nose section begins where the cone section ends, where the curvature of the blade begins, and extends to the shoulder section. More specifically, the nose section extends where the blade profile tangentially matches a circle formed by the nose radius. The nose section experiences much more, and more rapid, relative movement than does the cone section. Additionally, the nose section typically takes more weight than the other sections. As such, the nose section experiences much more wear than does the cone section. Therefore, the nose section preferably has a higher distribution, concentration, or density of total cutter material, or volume.

The shoulder section begins where the blade profile departs from the nose radius and continues outwardly on each blade 16 to a point where a slope of the blade is essentially completely vertical, at the gage section. The shoulder section experiences much more, and more rapid, relative movement than does the cone section. Additionally, the shoulder section typically takes the brunt of abuse from dynamic dysfunction, such as bit whirl. As such, the shoulder section experiences much more wear than does the cone section. The shoulder section is also a more significant contributor to rate of penetration and drilling efficiency than the cone section. Therefore, the shoulder section preferably has a higher distribution, concentration, or density of total cutter material, or volume. Depending on application, the nose section or the shoulder section may experience the most wear, and therefore either the nose section or the shoulder section may have the highest distribution, concentration, or density of total cutter material, or volume.

The gage section begins where the shoulder section ends. More specifically, the gage section begins where the slope of the blade is predominantly vertical. The gage section continues outwardly to an outer perimeter or gauge of the drill bit 10. The gage section experiences the most, and most rapid, relative movement with respect to the earth formation. However, at least partially because of the high, substantially vertical, slope of the blade 16 in the gage section, the gage section does not typically experience as much wear as does the shoulder section and/or the nose section. The gage section does, however, typically experience more wear than the cone section. Therefore, the gage section preferably has a higher distribution of total diamond volume than the cone section, but may have a lower distribution of total diamond volume than the shoulder section and/or nose section.

Figure 11:
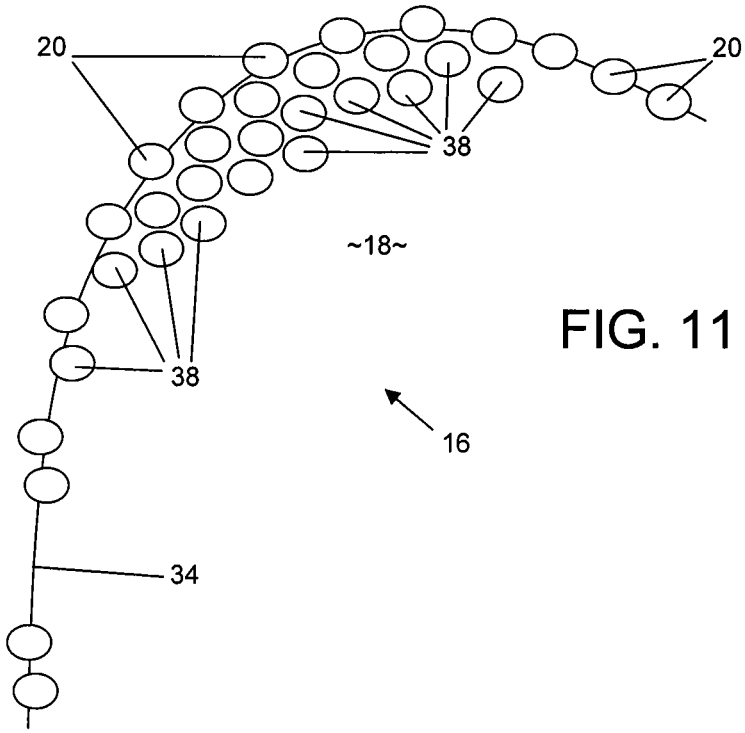
FIG. 11 is another partial elevation view of a blade of a drill bit according to certain aspects of the present inventions.

FIG. 11 shows one possible approach to accomplishing the above stated goals and/or design criteria. The blade 16 of FIG. 11 has a primary row of cutting elements 20. The blade 16 of FIG. 11 also has a cluster of secondary face cutters 38. These secondary face cutters 38 are distributed across the four sections, with tighter spacing, higher total diamond volume concentrations, and/or higher numbers of face cutters located in the shoulder section. More precisely, a highest concentration of the face cutters 38 or total diamond volume occurs near the border between the shoulder section and the gage section, where the highest wear rate may be expected. This allows the optimized drill bit 10 to continue providing an acceptable rate of penetration through the complete failure of one or even several cutting elements 20,38.

Figure 12:
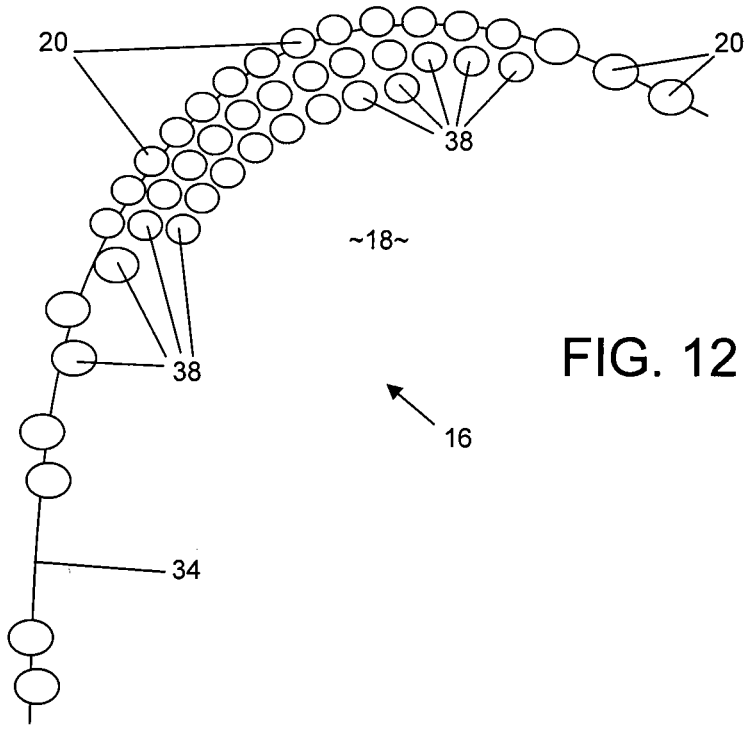
FIG. 12 is another partial elevation view of a blade of a drill bit according to certain aspects of the present inventions.

FIG. 12 shows another possible approach to accomplishing the above stated goals and/or design criteria. The blade 16 of FIG. 12 has a primary row of cutting elements 20. The blade 16 of FIG. 12 also has multiple rows of secondary face cutters 38. The primary face cutters 20 and secondary face cutters 38 around the shoulder section are smaller which allows for tighter spacing and higher total diamond volume distribution or concentrations. The secondary face cutters 38 are distributed across the three sections, with higher total diamond volume concentrations or numbers of face cutters located in the shoulder section. More precisely, a highest concentration of the face cutters 38 or total diamond volume occurs closer to the border between the shoulder section and the gage section, where the highest wear rate may be expected. This allows the optimized drill bit 10 to continue providing an efficient rate of penetration through the complete failure of one or even several cutting elements 20,38.

It can be seen that while the cutting profiles of the secondary face cutters 38 generally follows the cutting profile of the primary face cutters, the cutting profiles of the secondary face cutters 38 are abbreviated to cover a smaller portion of the blade 16. It should be noted that failure of every one of the primary face cutters 20 is not expected to occur simultaneously. Therefore, the drill bit 10 is expected to maintain an acceptable rate of penetration while operating partially on the primary cutting profile and partially on the secondary cutting profile(s).

Figure 13:
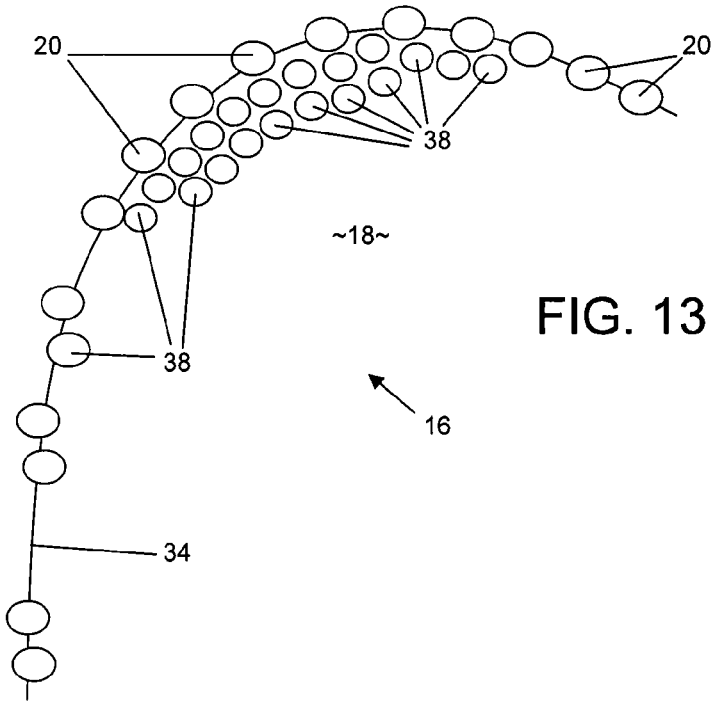
FIG. 13 is another partial elevation view of a blade of a drill bit according to certain aspects of the present inventions.

FIG. 13 shows still another possible approach to accomplishing the above stated goals and/or design criteria. The blade 16 of FIG. 13 has a primary row of cutting elements 20. The blade 16 of FIG. 13 also has multiple rows of secondary face cutters 38. The secondary face cutters 38 are smaller which allows for tighter spacing and higher total diamond volume distribution or concentrations. The secondary face cutters 38 are distributed across the three sections, with higher total diamond volume concentrations or numbers of face cutters located in the shoulder section. More precisely, a highest concentration of the face cutters 38 or total diamond volume occurs closer to the border between the shoulder section and the gage section, where the highest wear rate may be expected. This allows the optimized drill bit 10 to continue providing an acceptable rate of penetration through the complete failure of one or even several cutting elements 20,38.

It can be seen that the cutting profiles of the secondary cutters 38 are different than the cutting profile of the primary cutters. The cutting profiles of the secondary cutters 38 are also abbreviated to cover a smaller portion of the blade 16.

Figure 14:
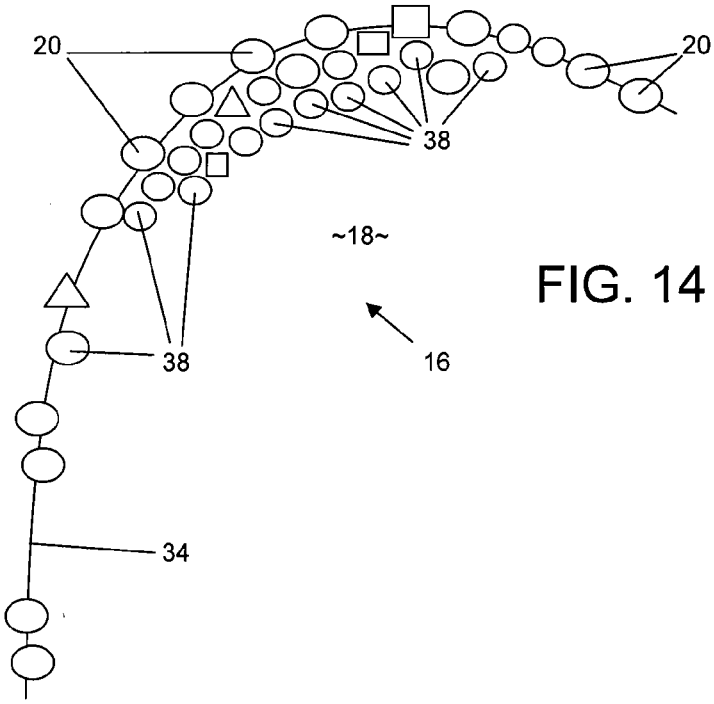
FIG. 14 is another partial elevation view of a blade of a drill bit according to certain aspects of the present inventions.

FIG. 14 shows that a combination of approaches may be used to accomplish the above stated goals and/or design criteria. The blade 16 of FIG. 14 has a primary row of cutting elements 20 comprising cutters of different sizes and shapes. The blade 16 of FIG. 14 also has multiple rows of secondary cutters 38 also comprising cutters of different sizes and shapes. Tighter spacing and higher total diamond volume distribution or concentrations in preferably occurs in the shoulder and gage sections. The secondary cutters 38 are distributed across the three sections, with higher total diamond volume concentrations or numbers of cutters located in the shoulder section. More precisely, a highest concentration of the cutters 38 or total diamond volume occurs closer to the border between the shoulder section and the gage section, where the highest wear rate may be expected. This allows the optimized drill bit 10 to continue providing an efficient rate of penetration through the complete failure of one or even several cutting elements 20,38.

Other and further embodiments utilizing one or more aspects of the inventions described above can be devised without departing from the spirit of Applicant's invention. For example, there may be one, two, three, or more rows of cutting elements. Further, the various methods and embodiments of the drill bit 10 can be included in combination with each other to produce variations of the disclosed methods and embodiments. For example, the first and/or second rows of cutters may comprise uniform cutters or may be composed of cutters of various sizes and/or shapes. Additionally, rather than the highest concentrations of diamond volume occurring in the shoulder section near the gage section as discussed above, the highest concentrations of diamond volume may occur in the gage section and may be near the shoulder section. Reading this disclosure, it can be appreciated that there are a number of ways to impact concentrations or distributions of cutter volume, such as by using differently sized, shaped, and/or spaced cutters. Discussion of singular elements can include plural elements and vice-versa.

While, at least in preferred embodiments, it is expected that the primary face cutters 20 will be arranged in a row following the profile of the blades 16, the secondary face cutters 38 may, but need not, be arranged in a row. For example, as shown above in FIG. 3 and FIG. 4, the secondary profile 40 may substantially match that of the primary profile 36, with a simple offset. In this case, there are two distinct rows of face cutters 20,38. Additionally, in this case, the offset is substantially vertical. Alternatively, or additionally, the offset could be horizontal. In still other configurations, as shown in FIG. 11 thru FIG. 14, the secondary face cutters 38 may not form a full row-like secondary profile. Rather, the secondary face cutters 38 may be grouped or clustered in and around areas of the blade 16 expected to experience the greatest wear rates. These sets, groups, or clusters may have relatively uniform distribution, within the set, or the distribution may be tapered, depending on the actual needs anticipated.

While FIG. 6 shows the primary and secondary face cutters 20,38 with essentially the same back rake, they could have different back rakes and/or different side rakes. More back and/or side rake may aid manufacturing of one-piece drill bits 10, as it may otherwise be difficult to mill out the secondary cutter pockets 44 on drill bits with higher blade counts 16.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A method of drilling a subterranean earth formation, the method comprising the steps of:

rotating a drill bit having a plurality of blades, each blade having a forward facing face, with respect to a direction of rotation of the bit, with at least first and second rows of cutting elements disposed within individual pockets at least partially recessed into the face and having an abrasion resistance, wherein the plurality of blades are formed of a blade material having an abrasion resistance that is less than the abrasion resistance of the cutting elements;

abrading the blades beyond the first row of cutting elements, thereby exposing the second row of cutting elements to the earth formation, wherein the cutting elements in the first and second rows are uniform, such that the cutting elements in the first and second rows are polycrystalline diamond compact (PDC) cutting elements;

wherein the blade material erodes when it comes into frictional contact with the earth formation being drilled after the first row of cutting elements has been abraded;

wherein none of the cutting elements of the second row contacts the formation until one of the cutting elements of the first row fails, and wherein the first row of cutting elements forms a first curved cutting profile, the second row of cutting elements forms a second curved cutting profile, the second profile is substantially identical to the first profile, and the second profile is offset from the first profile.

2. The method as set forth in claim 1, wherein each pocket provides lateral support for one of the cutting elements.

3. The method as set forth in claim 1, wherein each cutting element extends from within the blade, through the face, and into a slot between the blades of the drill bit.

4. The method as set forth in claim 1, wherein the second row of cutting elements is offset inwardly from the first row.

5. A drill bit, the drill bit comprising:

a bit body;

a plurality of blades spaced around the bit body, each blade having a curved outer edge and a forward face, with respect to a direction of rotation of the bit, each blade further having a cone section, a nose section, a shoulder section, and a gage section;

a first row of cutter pockets at least partially recessed into the forward face along the outer edge of each blade;

a second row of cutter pockets at least partially recessed into the forward face of each blade offset vertically from the first row;

a plurality of cutting elements, with each cutting element secured at least partially within a different one of the cutter pockets, such that the cutting elements in the first row of cutter pockets and the second row of cutter pockets are polycrystalline diamond compact (PDC) cutting elements;

wherein none of the cutting elements of the second row directly contacts the formation until at least one of the cutting elements of the first row fails, such that after failure of the cutting element of the first row and engagement of the cutting element of the second row, the bit retains useful performance using cutting elements of the first row and cutting elements of the second row simultaneously, and wherein the first row of cutter pockets forms a first curved cutting profile, the second row of cutter pockets forms a second curved cutting profile, the second profile is substantially identical to the first profile, and the second profile is offset vertically from the first profile.

6. The drill bit as set forth in claim 5, wherein each pocket provides lateral support for one of the cutting elements.

7. The drill bit as set forth in claim 5, wherein each cutting element extends from within the blade, through the face, and into a slot between the blades of the drill bit.

8. The drill bit as set forth in claim 5, wherein the cutting elements in the first row are of a different type than the cutting elements in the second row.

9. The drill bit as set forth in claim 5, wherein the first row of cutting elements is offset outwardly from the second row.

10. The drill bit as set forth in claim 5, wherein the face of each blade is substantially flat.

11. The drill bit of claim 5, wherein the cutting elements of the second row are distributed across the nose, shoulder, and gage sections of each blade.

12. The drill bit of claim 11, wherein there are a higher number of cutting elements of the second row proximate to the region between the shoulder section and the gage section of the forward face of each blade than in the nose and cone sections of the forward face of each blade.

13. A drill bit for drilling a well into an earth formation, the drill bit comprising:

a bit body;

a plurality of blades spaced around the bit body, each blade having a curved outer edge and a forward face with respect to a direction of rotation of the bit, each blade further having a cone section, a nose section, a shoulder section, and a gage section;

a first row of cutting elements at least partially recessed into the forward face along the outer edge of each blade;

a second row of cutting elements at least partially recessed into the forward face of each blade offset vertically from the outer edge and the first row;

wherein the cutting elements are polycrystalline diamond compact (PDC) cutting elements across both rows, and wherein none of the cutting elements of the second row directly contacts the formation until at least one of the cutting elements of the first row fails, such that after failure of the cutting element of the first row and engagement of the cutting element of the second row the bit retains useful performance while using a portion of the first row and a portion of the second row, wherein the first row of cutting elements forms a first curved cutting profile, the second row of cutting elements forms a second curved cutting profile, the second profile is substantially identical to the first profile, and the second profile is offset vertically from the first profile, and wherein the curved outer edge is substantially perpendicular to the forward face and at least one of the cutting elements of the first row of is aligned substantially parallel to at least one of the cutting elements of the second row.

14. The drill bit as set forth in claim 13, wherein each cutting element extends from within the blade, through the face, and into a slot between the blades of the drill bit.

15. The drill bit as set forth in claim 13, wherein the second row of cutting elements is offset inwardly from the first row.

16. The drill bit as set forth in claim 13, wherein the face of each blade is substantially flat.

17. The drill bit of claim 13, wherein the cutting elements of the second row are distributed across the nose, shoulder, and gage sections of each blade, such that there are a higher number of cutting elements of the second row proximate to the region between the shoulder section and the gage section of the forward face of each blade than in the nose and cone sections of the forward face of each blade.

* * * * *